US011352710B2

(12) United States Patent
Ildeniz

(10) Patent No.: US 11,352,710 B2
(45) Date of Patent: Jun. 7, 2022

(54) LEAK FREE BRUSH ELECTROPLATING SYSTEM

(71) Applicant: Abdurrahman Ildeniz, Greenland, NH (US)

(72) Inventor: Abdurrahman Ildeniz, Greenland, NH (US)

(73) Assignee: Abdurrahman Ildeniz, Greenland, NH (US)

( * ) Notice: Subject to any disclaimer, the term of this patent is extended or adjusted under 35 U.S.C. 154(b) by 81 days.

(21) Appl. No.: 16/587,883

(22) Filed: Sep. 30, 2019

(65) Prior Publication Data

US 2021/0095389 A1 Apr. 1, 2021

(51) Int. Cl.

| | |
|---|---|
| ***C25D 21/06*** | (2006.01) |
| ***C25D 17/12*** | (2006.01) |
| ***C25D 21/12*** | (2006.01) |
| ***C25D 17/14*** | (2006.01) |

(52) U.S. Cl.
CPC ..... *C25D 21/06* (2013.01); *C25D 17/12* (2013.01); *C25D 17/14* (2013.01); *C25D 21/12* (2013.01)

(58) Field of Classification Search
CPC ..... C25D 5/06; C25D 17/14; C25D 21/04
See application file for complete search history.

(56) References Cited

U.S. PATENT DOCUMENTS 3,751,343 A * 8/1973 Macula et al. ..... C25D 17/14 205/118
5,382,343 A * 1/1995 Zwerner ..... C25D 5/06 204/224 R
2002/0020627 A1* 2/2002 Kunisawa ..... H01L 21/6715 205/96
2003/0234181 A1* 12/2003 Palumbo ..... C25D 15/02 205/115
2004/0191949 A1* 9/2004 Iwata ..... H01L 31/1884 438/98
2004/0194698 A1* 10/2004 Hongo ..... C25D 17/001 118/429
2005/0139477 A1* 6/2005 Muranushi ..... C25D 21/14 205/101
2005/0178666 A1* 8/2005 Tsai ..... B23K 5/08 205/118
2006/0137974 A1* 6/2006 Du ..... C25D 5/08 204/232
2011/0056840 A1* 3/2011 Isono ..... C25D 21/10 205/296
2015/0184308 A1* 7/2015 Chaix ..... C25D 11/022 204/276
2015/0340249 A1* 11/2015 Lee ..... C25D 17/004 156/345.21
2018/0171500 A1* 6/2018 Chen ..... C25D 3/665

OTHER PUBLICATIONS

Sample Format for Revised Amendment Practice (Year: 2003).*

* cited by examiner

*Primary Examiner* — Harry D Wilkins, III
*Assistant Examiner* — Ho-Sung Chung

(57) ABSTRACT

In any overhead job, operators will feel more relaxed and safer. In any systems, the operators won't have to spend days for masking and sealing. Simple protection will be enough. With this unit operators can use toxic solutions like cadmium and silver without any health concern, because the anode returns the toxic vapors back to the chamber and filtered suction line in front of the exhaust valve will take the toxic vapor away. Pit filling anode save the workers time and effort drastically by filling the pits bottom up in one shot.

13 Claims, 25 Drawing Sheets

LEAK FREE BRUSH ELECTROPLATING SYSTEM

BACKGROUND OF THE INVENTION

Metal plating has been used for hundreds of years to provide objects and mechanical components with additional and desired properties of specific metal. Depending on the preferred outcome, different types of metal or alloys including copper, aluminum, tin, gold, cadmium, rhodium, zinc, silver, nickel or chromium may be used in the plating process.

Just like a circuit, electroplating process relies on different components, or electrodes, to achieve the thin metal coating. The item selected for plating is the cathode—the negatively charged electrode, while the material or metal used makes up the anode—the positively charged electrode. Both components are immersed in an electrolyte bath that contains metal salts and other ions to allow for the proper flow of electricity.

In some cases, metal plating may be required in more localized areas. This process, which is related to electroplating is often referred to as selective plating or brush plating. The brush anode (FIG. 1), which is usually contain plastic core (FIG. 1-1) covered with platinum clad niobium mesh (FIG. 1-2) wrapped in cotton batting (FIG. 1-3), holds the plating solution and inhibits the item from making direct contact with the metal mesh. Through the use of low voltage, the anode dipped in plating solution or pump the solution slowly on it allows for localized plating by an operator. Skilled operators can use this selective electroplating service to apply for spot-plating techniques, making it useful in both the repair and refurbishment of parts and components. Unlike full electroplating techniques which required an immersion in an electrolyte bath, selective plating allows the operator to target a specific area using a plating solution of electrolyte and anode connected to positive lead by masking adjacent area.

In many ways, brush plating may appear similar to welding when compared to other forms of electroplating because it uses a flexible and maneuverable anode attached to a power supply. The cathode is still the component you have selected for plating, but the anode is now connected to a handle and wrapped in an absorbing material, usually cotton batting. The cloth absorbs the electrolyte during the brush plating process.

As the operator moves the anode over the cathode, it completes the circuit and supplies the electrolyte continuously. The electrolyte can be supplied via a pump or by dipping.

One of the greatest advantage that brush plating services, or selective electroplating services, offer over a traditional immersion bath—or tank plating methods, is flexibility. The equipment for brush plating is mobile and can be done anywhere—from the workshop to on site or on board at a customer's location, without requiring the transportation or shipment of any heavy and delicate components. Some components are welded to the hull of a ship and the main engine can not be separated to carry to a workshop and have to be repaired on their spot.

This is ideal and much faster than traditional electroplating techniques. It allows for the service, repair and refurbishment of parts quickly. In addition, it may also reduce the need for machining since metal can be deposited onto component in thin layer. While there are no limitation such as level of thickness that can be achieved.

On board brush plating process, one of the most time consuming steps is masking and sealing the system for leakage. Electrolyte dipped anode can not hold the solution for good. Gravity let the solution slowly leak out or if we are pumping the solution on the anode you have to catch excess solution to reach the undesirable surfaces in the system. Plating solutions are highly corrosive and any simple leakage creates harm to the system. When operators plating any components overhead, they have to protect themselves and the surrounding area from dripping the solution with extra personal protection equipment and coverage.

Brief Summery of the Invention

I designed a portable light weight units which contains the anodes (FIG. 2-1 thru 5) that is always desirably wet and does not drip. The unit simply works two system in balance. The delivery system that contains peristaltic pump (FIGS. 2 & 3-15) which supplies the solution to the anode handle (FIGS. 2 & 6-1) from the solution chamber (FIGS. 2 & 3-14). The distributor (FIGS. 2 & 6-2) spreads the solution in cotton batting (FIGS. 2 & 6-5) at multiple points to keep it completely wet. The suction system has a vacuum pump ejector (FIGS. 2 & 3-6) which works with compressed pressure air. The vacuum pump ejector sucks the excess solution and sends the air and solution mixture back to the chamber. Multiple suction points on the anode helps the solution to travel in the cotton batting evenly. When air and solution mixture hits the muffler (FIGS. 2 & 3-7) in the chamber, the solution flows down and the air leaves from the exhaust valve (FIGS. 2 & 3-8).

DETAIL DESCRIPTION OF THE INVENTION

Figure 1:
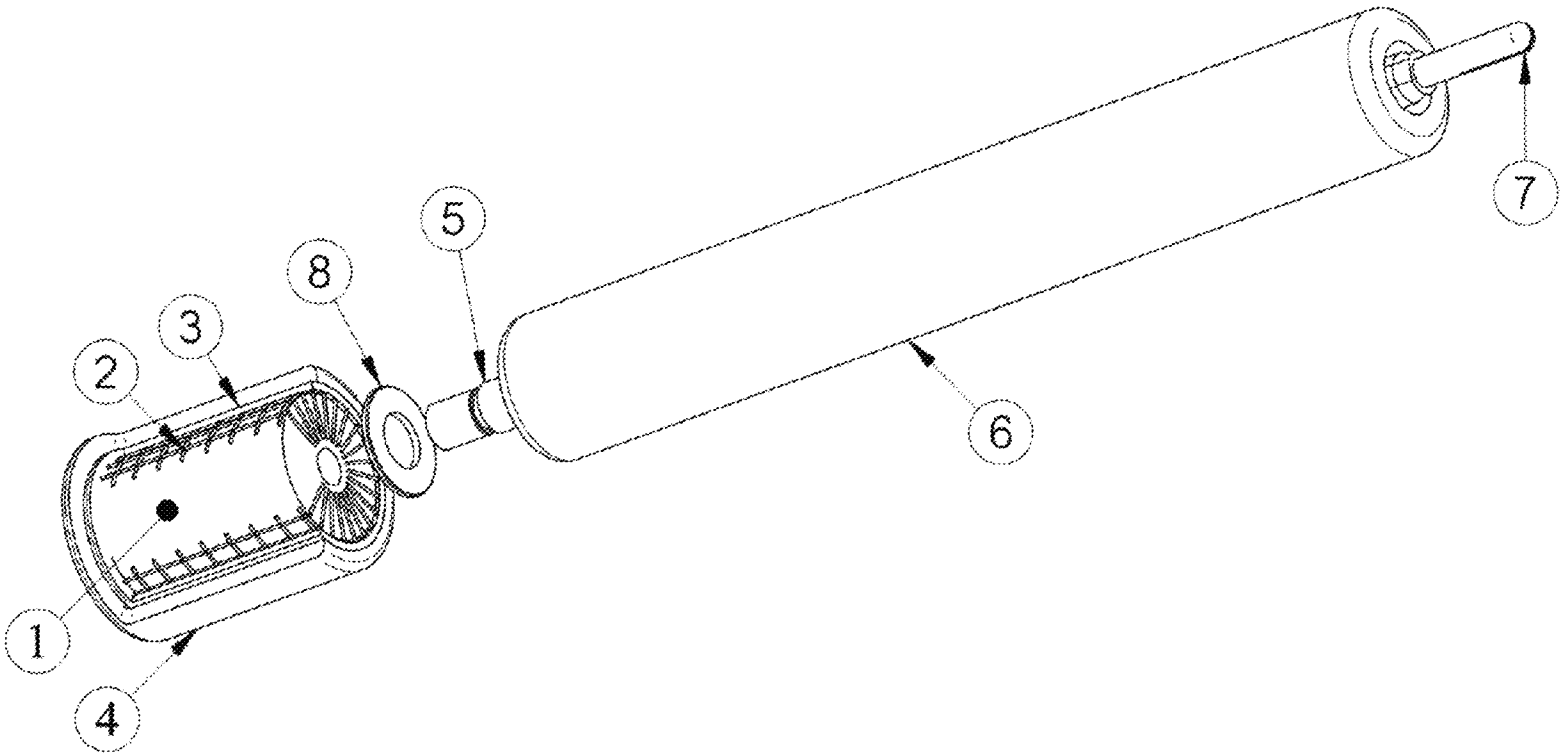
FIG. 1—Traditional brush electroplating anode.
Figure 2:
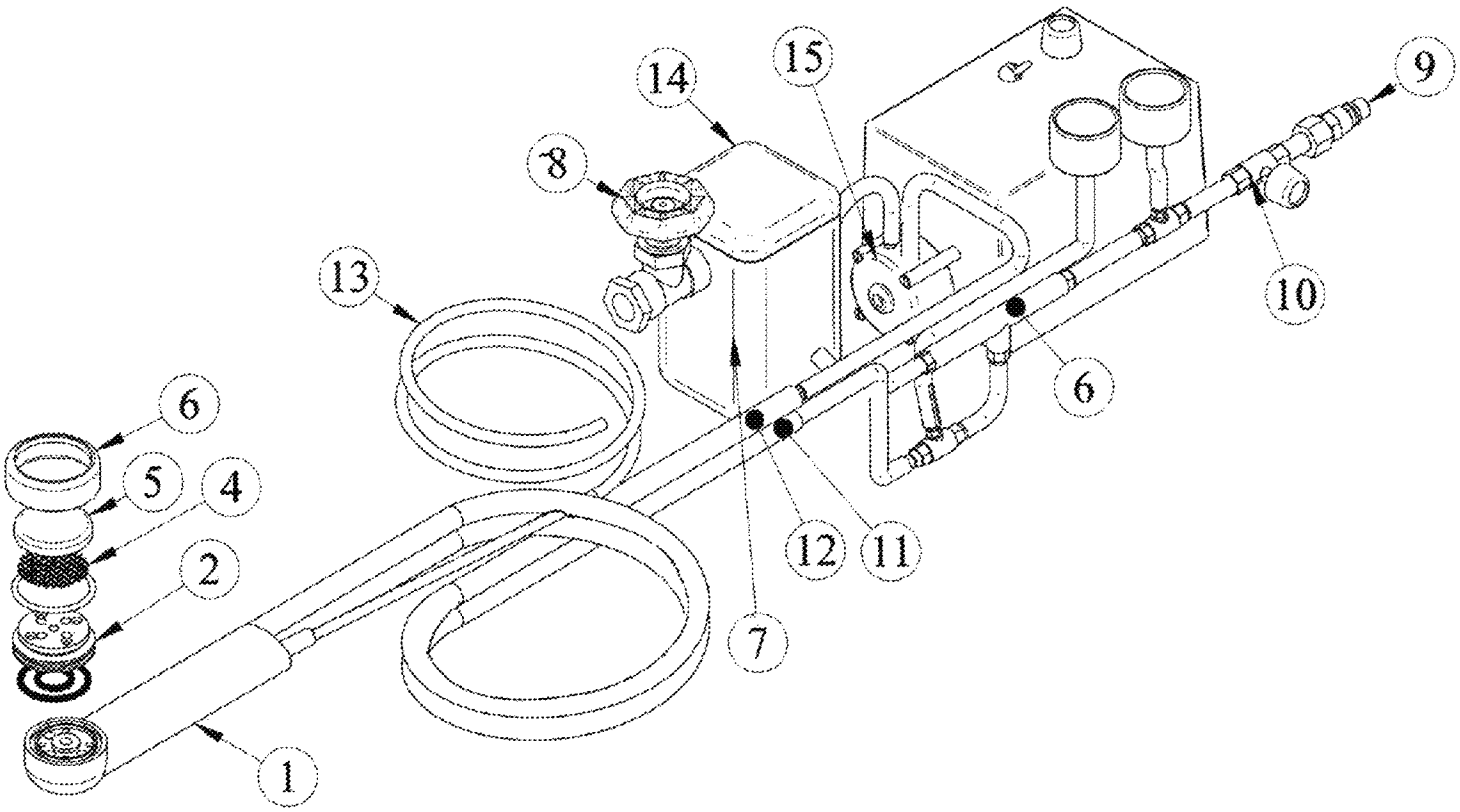
FIG. 2—Leak Free Electroplating unit and a surface anode connected.
Figure 7:
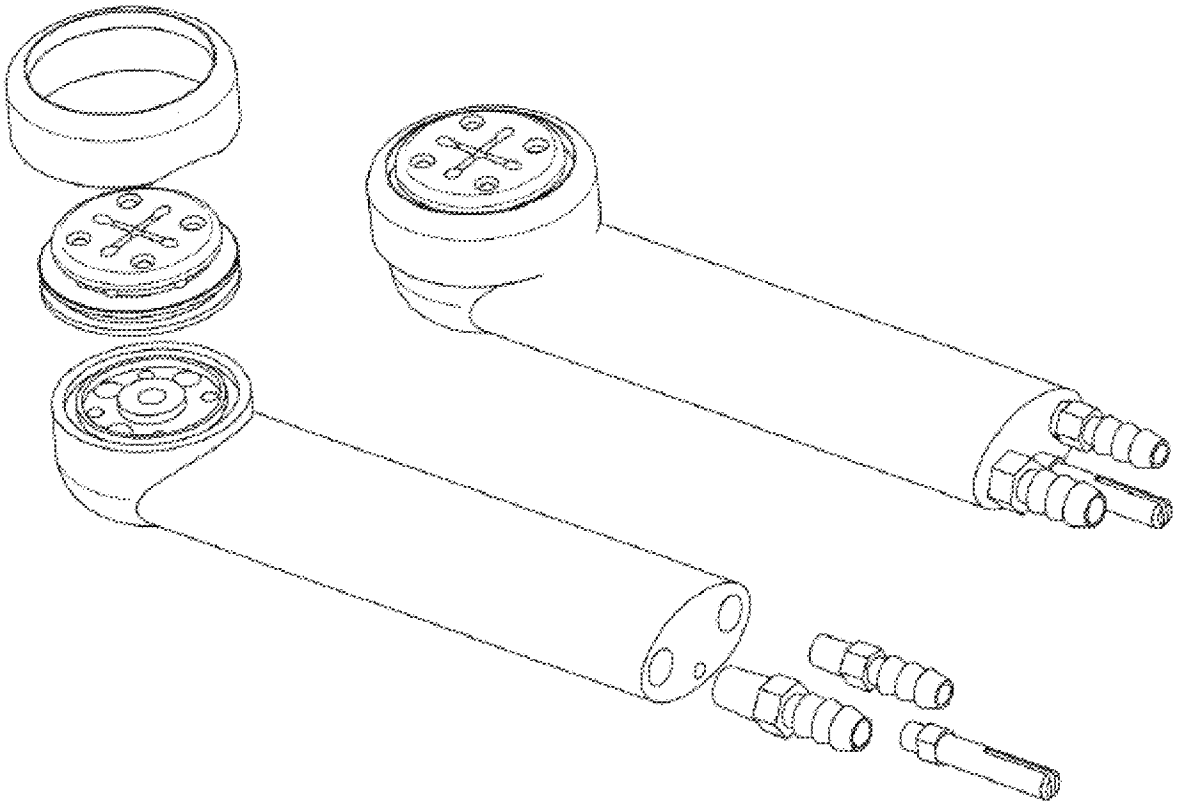
FIG. 7—Surface anode's assembly perspective drawing.
Figure 8:
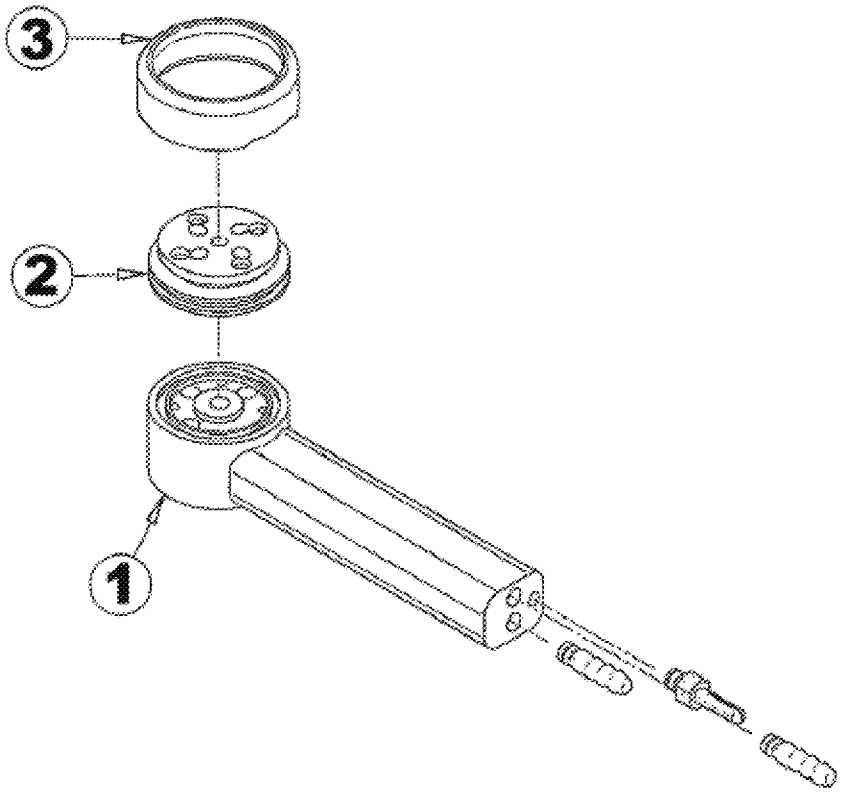
FIG. 8—Surface anode's assembly perspective drawing.
Figure 9:
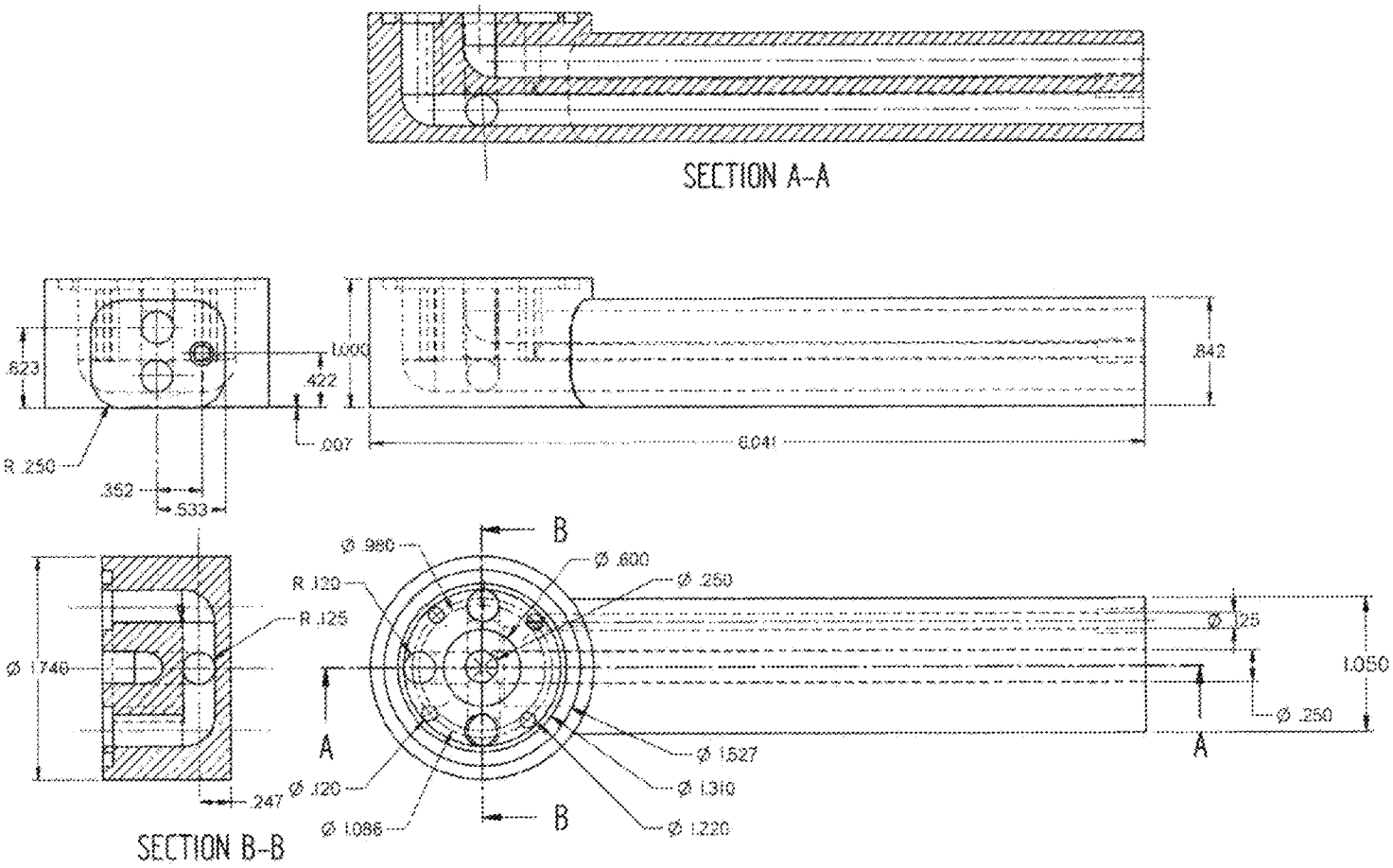
FIG. 9—Surface and Pit filling anode handle's draft drawing.
Figure 10:
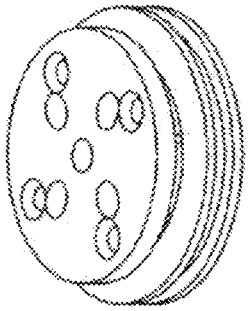
FIG. 10—Surface anode distributor's draft drawing.
Figure 10:
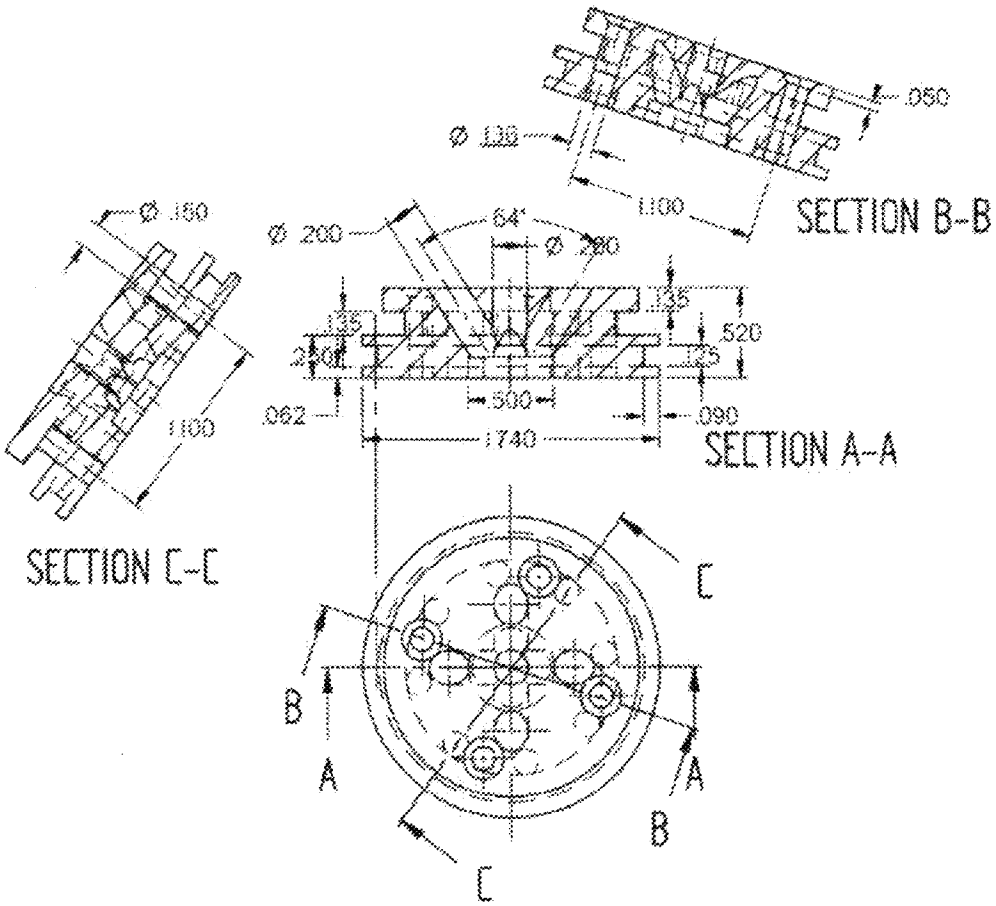
Figure 11:
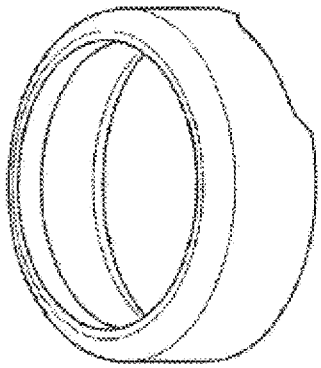
FIG. 11—Surface anode cover ring's draft drawing.
Figure 11:
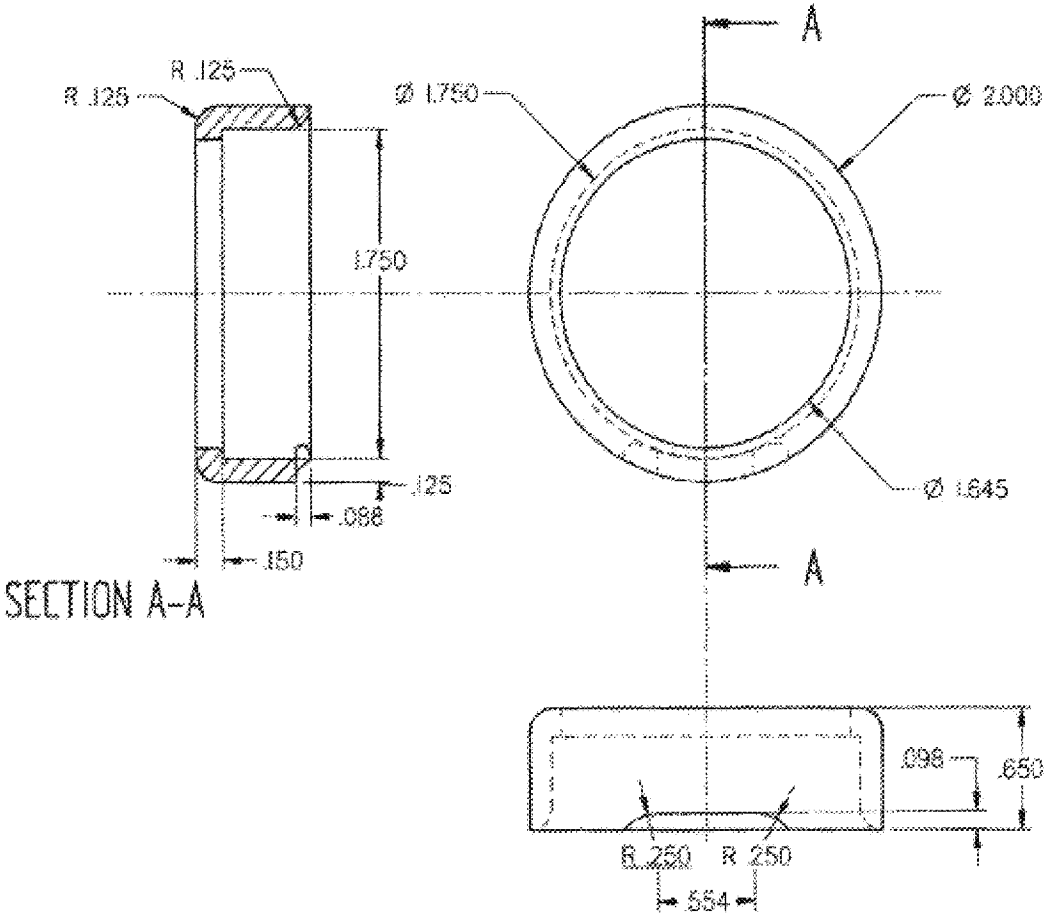
Figure 12:
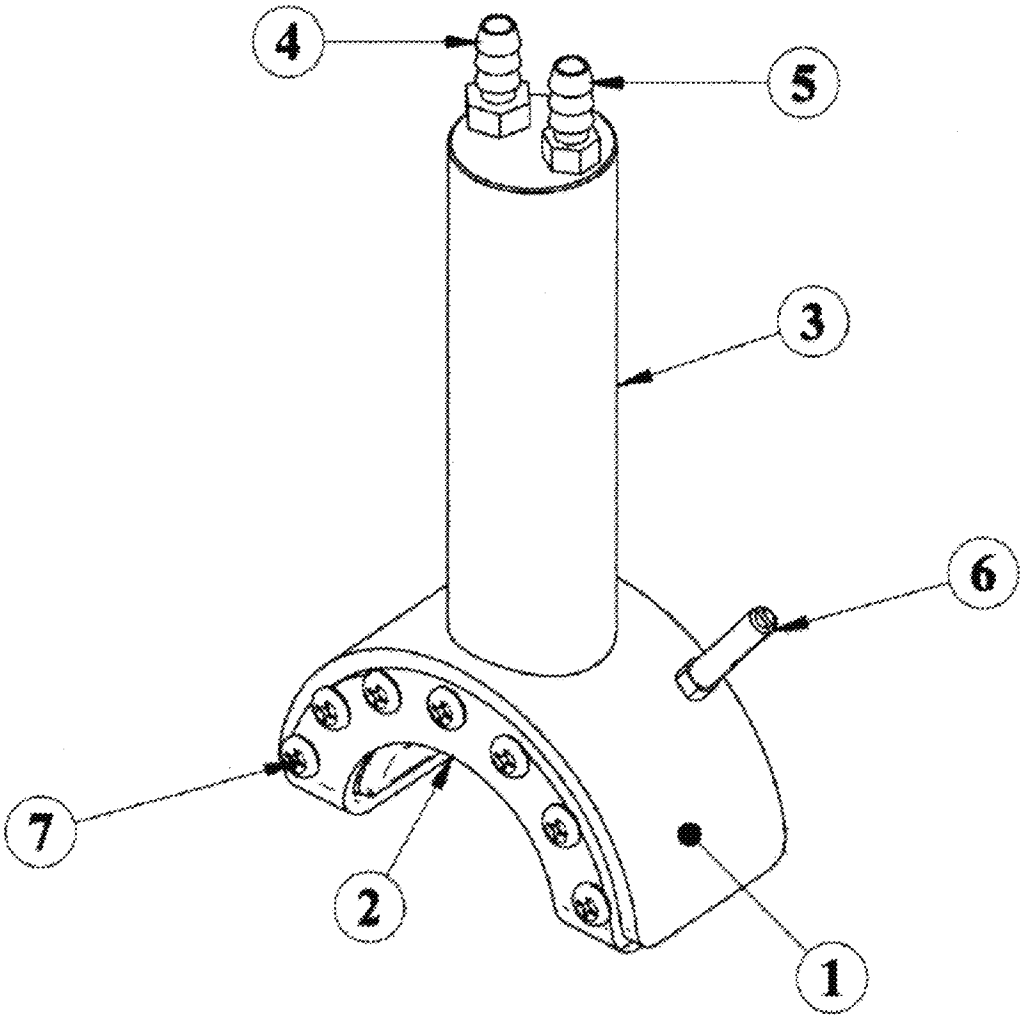
FIG. 12—Shaft anode's assembly perspective drawing.
Figure 13:
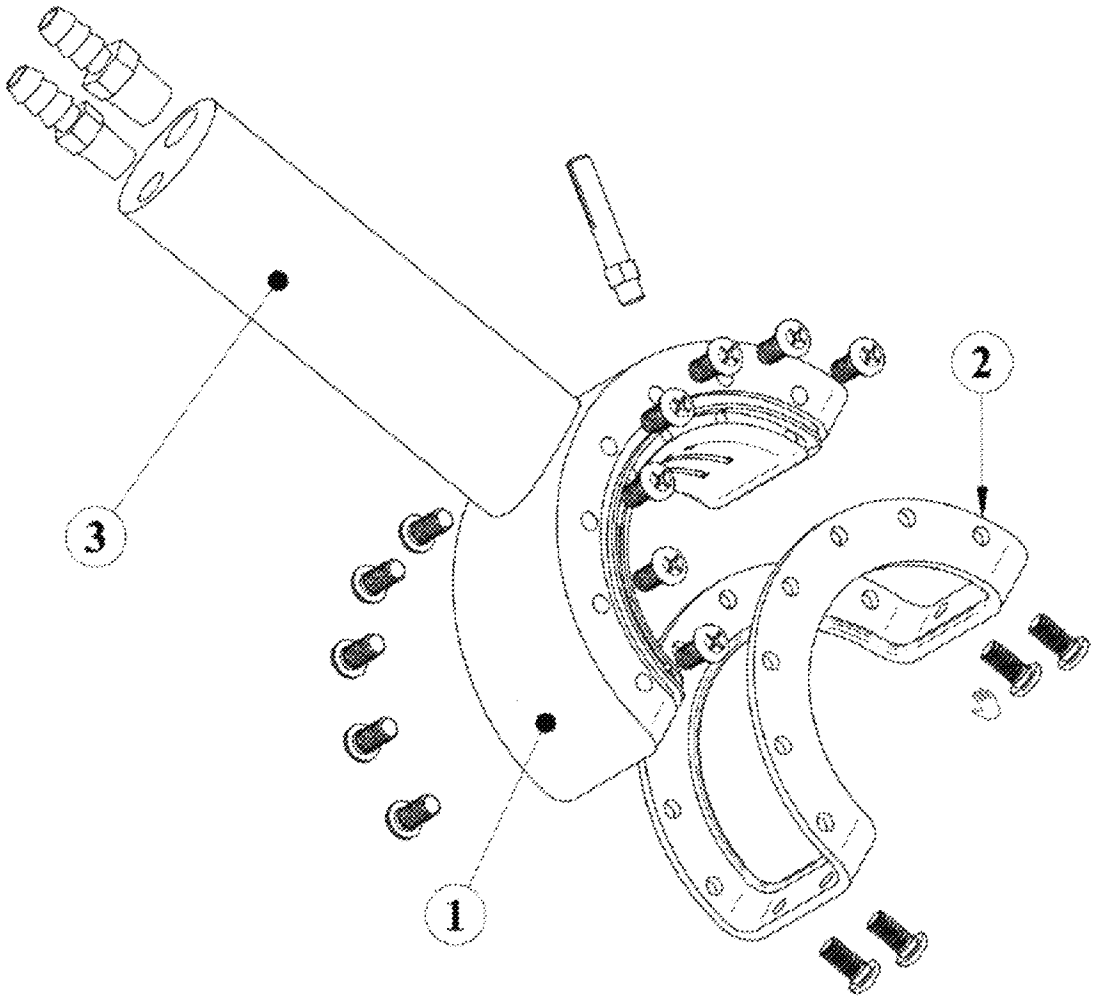
FIG. 13—Shaft anode's exposed parts.
Figure 14:
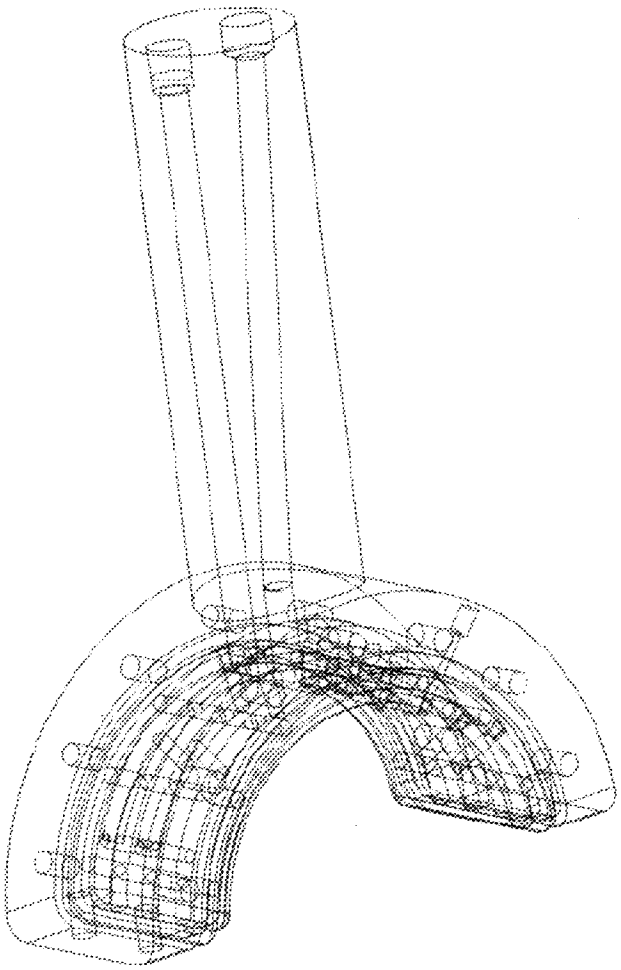
FIG. 14—Transparent perspective of Shaft anode to show the channels in it.
Figure 15:
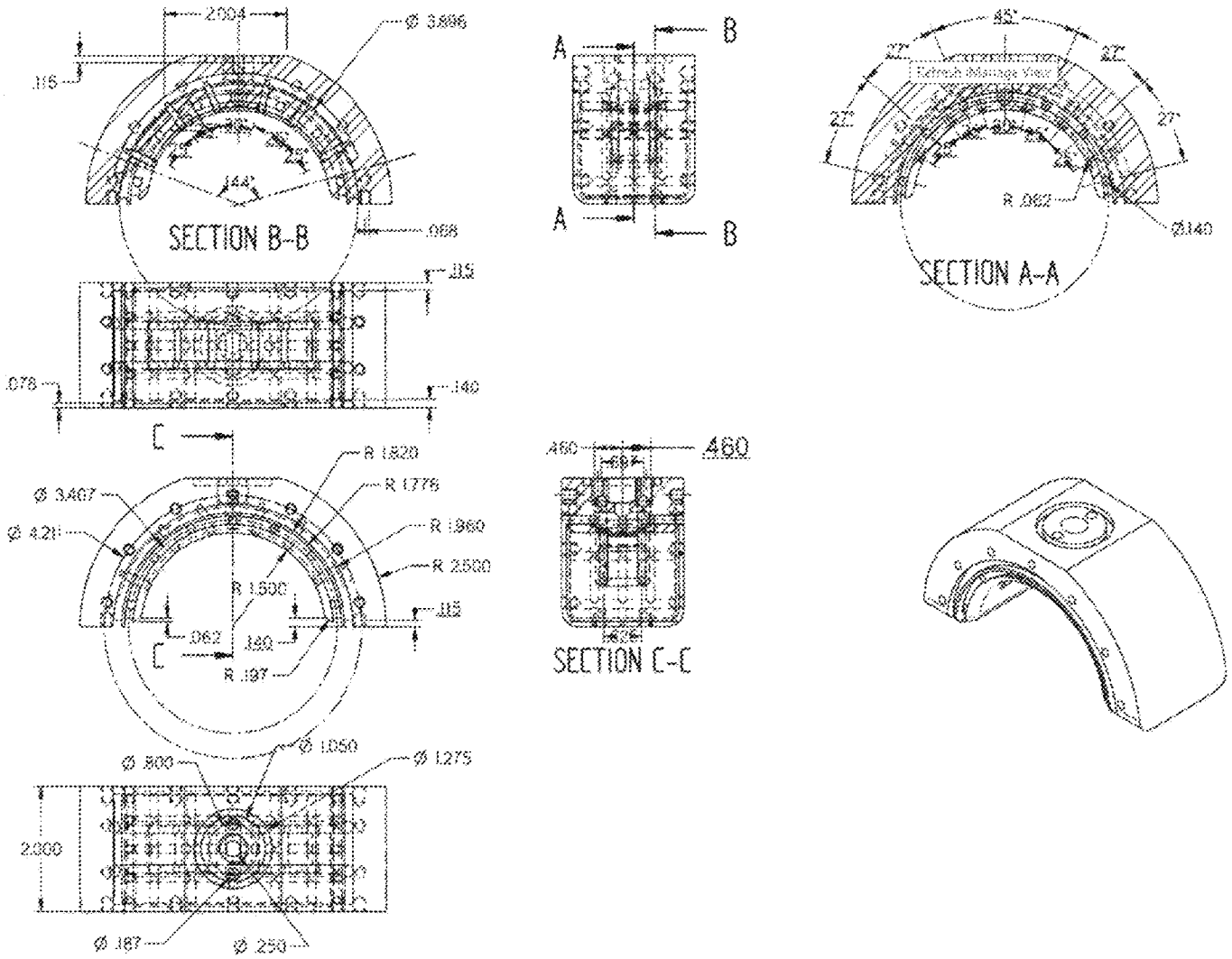
FIG. 15—Shaft anode distributor's draft drawing.

The unit has 2 different systems; first is the delivery system that contains a peristaltic pump (FIGS. 2 & 3-15), second is the suction system that contains a vacuum pump ejector (FIGS. 2 & 3-6). The adjustable two ways peristaltic pump deliveries the solution to the anode handle (FIGS. 2 & 6-1) from the chamber canister (FIGS. 2 & 3-14). The vacuum pump ejector works by the compressed pressure air (FIGS. 2 & 3-9) which creates suction to return the solution to the chamber. The air valve (FIGS. 2 & 3-10) adjusts the pressure of the air. This way we can adjust the vacuum to keep the anode perfectly wet without any dripping. Referring to FIG. 2, pressurized air 9 enters the suction system valve 10. The valve 10 has an adjustment knob that varies the vacuum by varying the pressurized air 9 to the vacuum pump ejector 6. Referring to FIG. 7, the distributor has a "+" shaped outlet for the solution surrounded by four suction inlets adjacent the perimeter. In FIG. 8, the distributor has five outlets in a dice pattern, e.g., arranged like the dots of the side of dice that have five dots.

First we fill the chamber (FIGS. 2 & 3-14) with solution to the mark and close the lid and lock it down for security. We connect the suction (FIGS. 2 & 3-11) and the delivery (FIGS. 2 & 3-12) hoses from the anode handle (FIGS. 2 & 6-1) to the unit. Then we open the chamber's exhaust valve (FIGS. 2 & 3-8) that releases the air coming in with suction. After replace the anode in a tray we then open the air valve (FIGS. 2 & 3-10) to start suction and start the pump (FIGS. 2 & 3-15) to deliver solution to the anode. When solution arrives to the anode we adjust the volume of solution by the pump and adjust the suction in balance by the air valve. The batting (FIGS. 2 & 6-5) on the anode should be completely wet but should not drip. We start electroplating by connecting the positive lead (FIGS. 2 & 6-13) to the anode.

This unit simply works two systems in balance. The delivery system supplies the solution to the anode and the distributor spreads it at multiple points to completely wet the batting. In the suction system, during the pressure air passing thru the vacuum pump ejector, it creates a vacuum in front of the nozzle to suck the solution from the anode and then sends the air-solution mixture back to the chamber. The multiple suction points on the distributor help the solution travel in the bathing evenly. When air solution mixture hits the baffle in the chamber, the solution then flows down in the chamber and the air leaves from the exhaust valve. The baffle is two angled plates below the point where the air leaves from the exhaust valve connection to the chamber as shown in FIG. 2. Placing a filtered suction line in front of the exhaust valve is environmentally recommended because of the possibility of the solution vapor.

Figure 3:
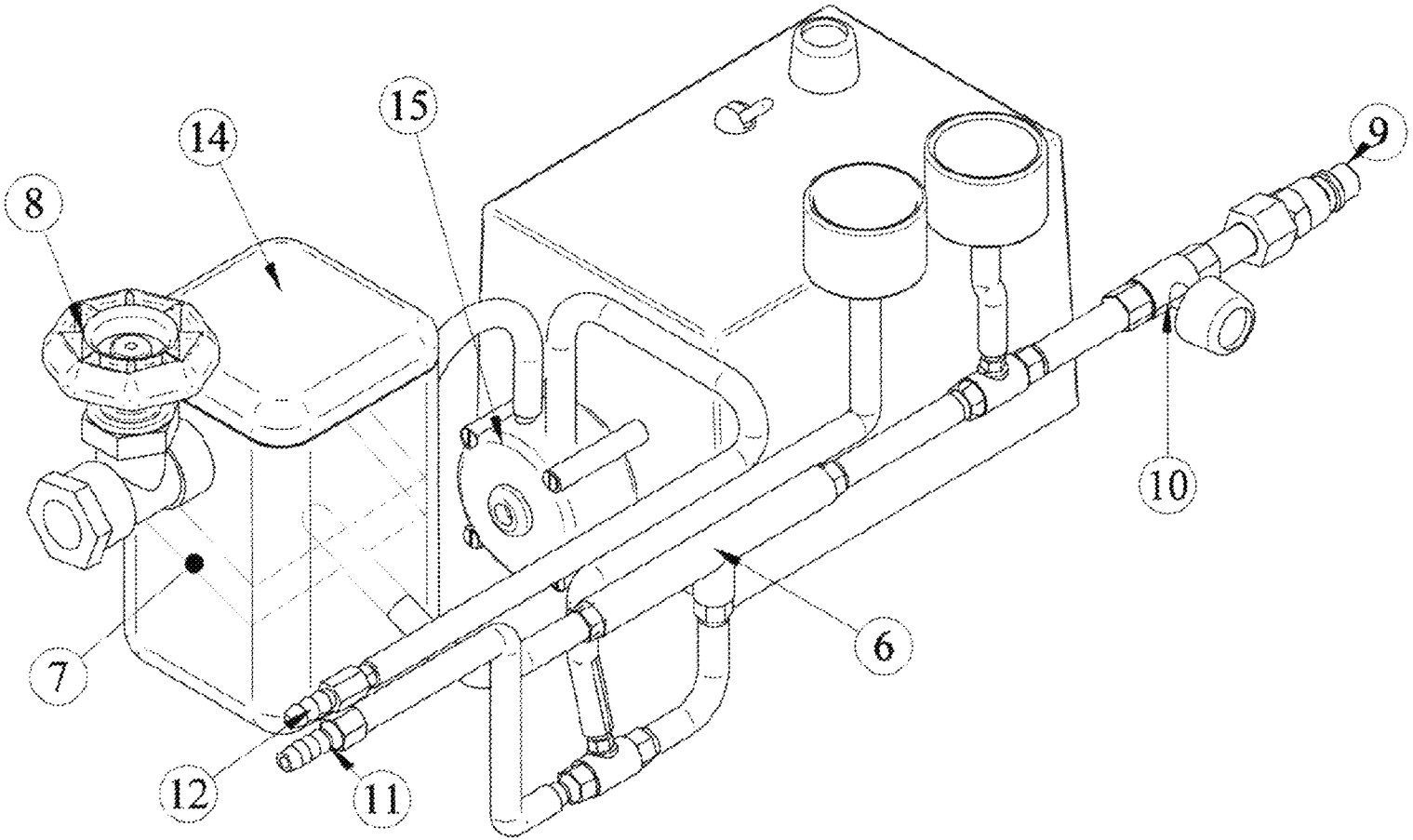
FIG. 3—Leak Free Electroplating unit.
Figure 5:
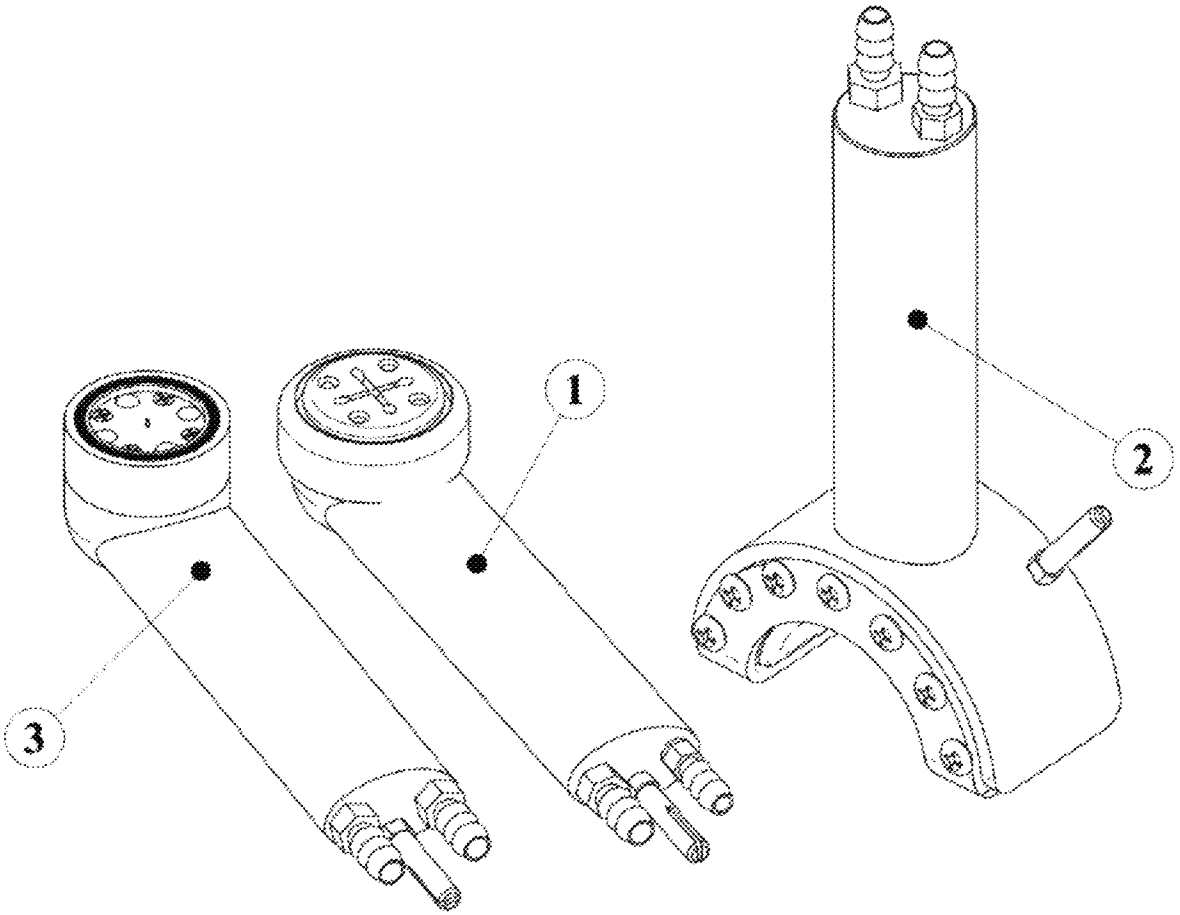
FIG. 5—Actual picture of three Leak Free system anodes.
Figure 6:
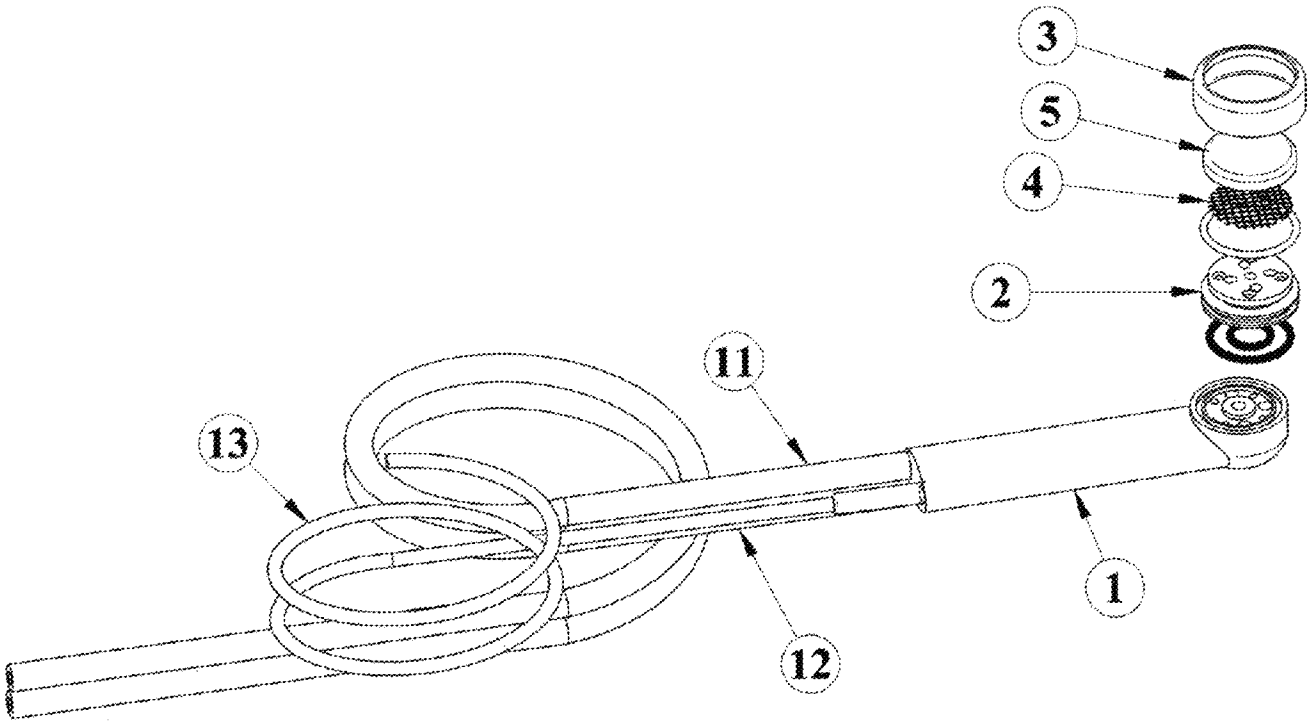
FIG. 6—Surface anode's exposed parts.

I designed three different anodes for their purposes; flat surface anode (FIG. 5-1), cylindrical surface anode (FIG. 5-2) like a shaft surface with different diameters and small pit filing anode (FIG. 5-3). All anodes can be used with the same units.

The flat surface anode (FIG. 5-1)(FIG. 6 thru 11) have 3 main pieces; the Anode handle (FIGS. 2, 6 & 8-1)(FIG. 9) delivers the solution and returns it back, the Distributor (FIGS. 2, 6 & 8-2)(FIG. 10) spreads the solution and collects it back from multiple points and the Cover ring (FIGS. 2, 6 & 8-3)(FIG. 11) holds the cotton batting (FIGS. 2 & 6-5) and Platinum clad niobium mesh (FIGS. 2 & 6-4) down.

Shaft anode (FIG. 5-2)(FIG. 12 thru 15) have 3 main pieces; the Anode handle (FIGS. 12 & 13-3) delivers the solution and returns it back, the Distributor (FIGS. 12 & 13-1)(FIG. 15) spreads the solution and collects it back from multiple points and the Cover ring (FIGS. 12 & 13-2) holds the cotton batting and platinum clad niobium mesh.

Figure 4:
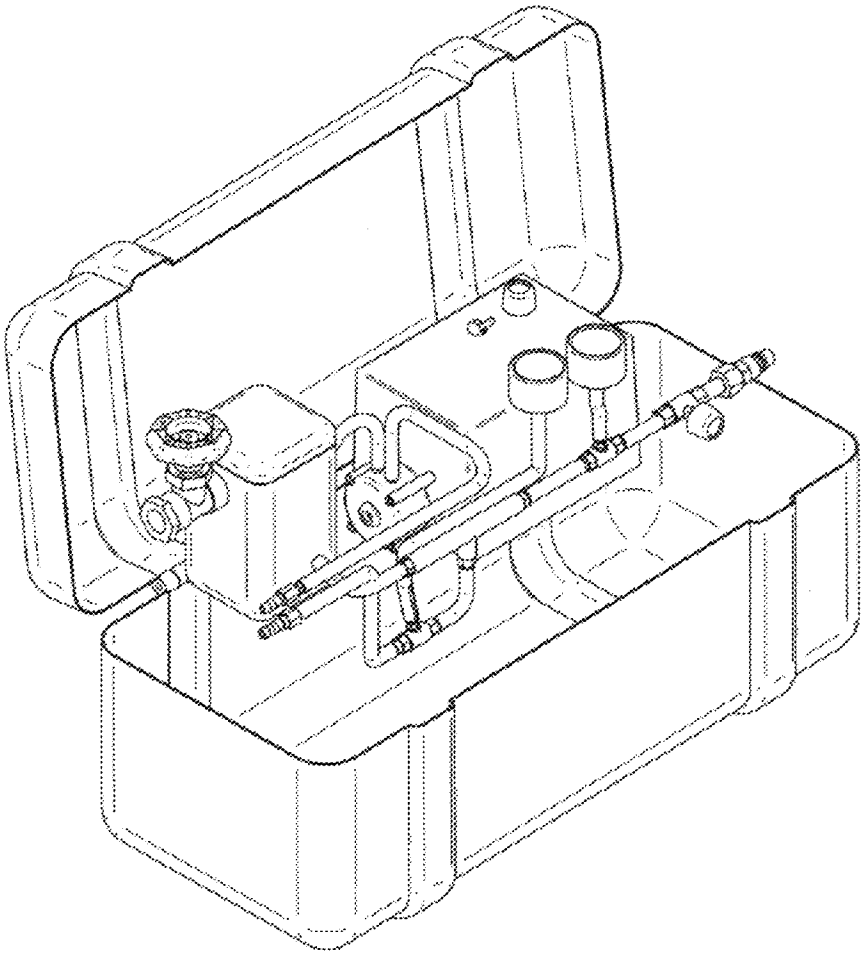
FIG. 4—Leak Free Electroplating system exposed from carrying case.
Figure 16:
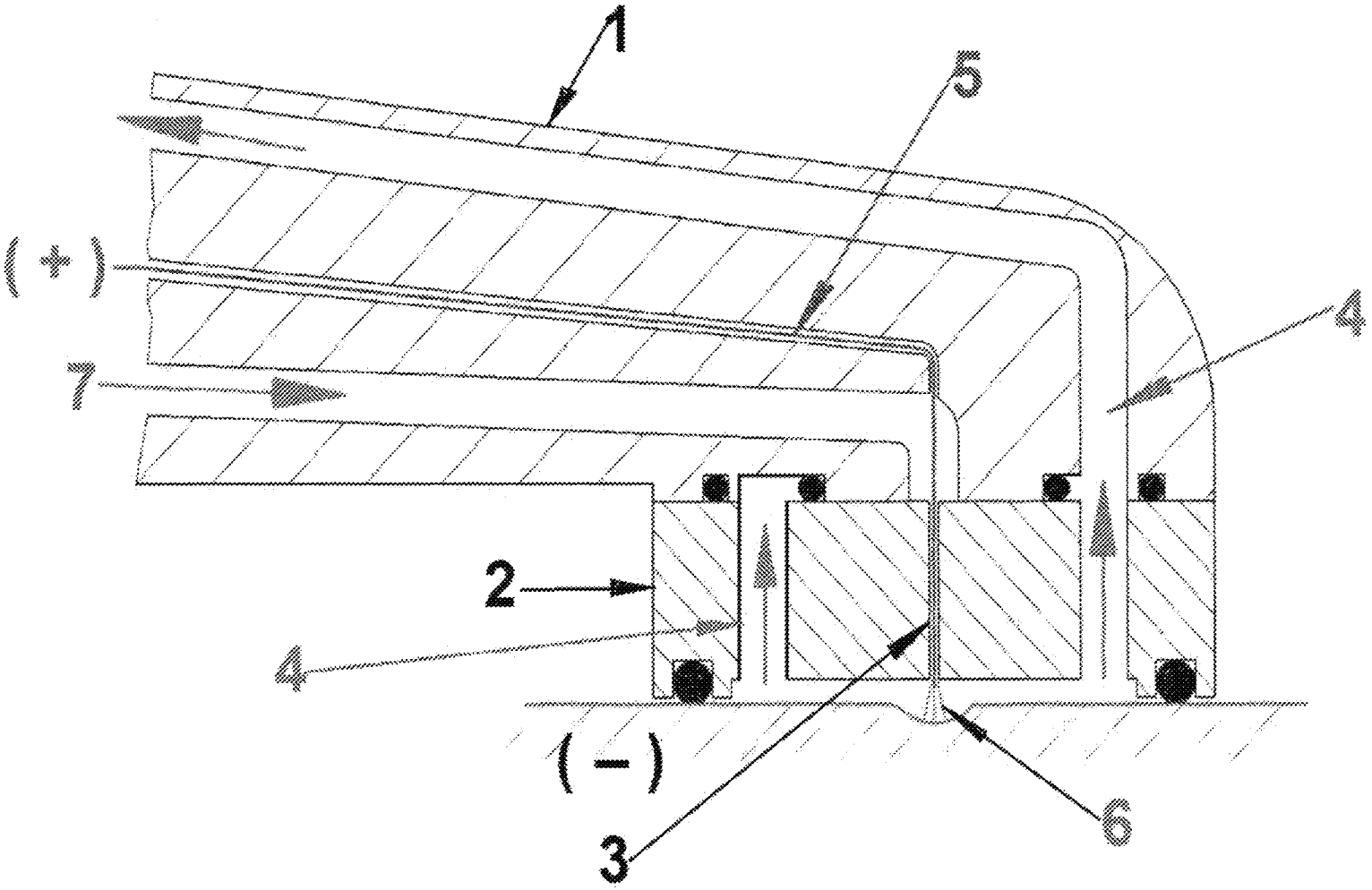
FIG. 16—Sketch of how Pit filling anode works.
Figure 17:
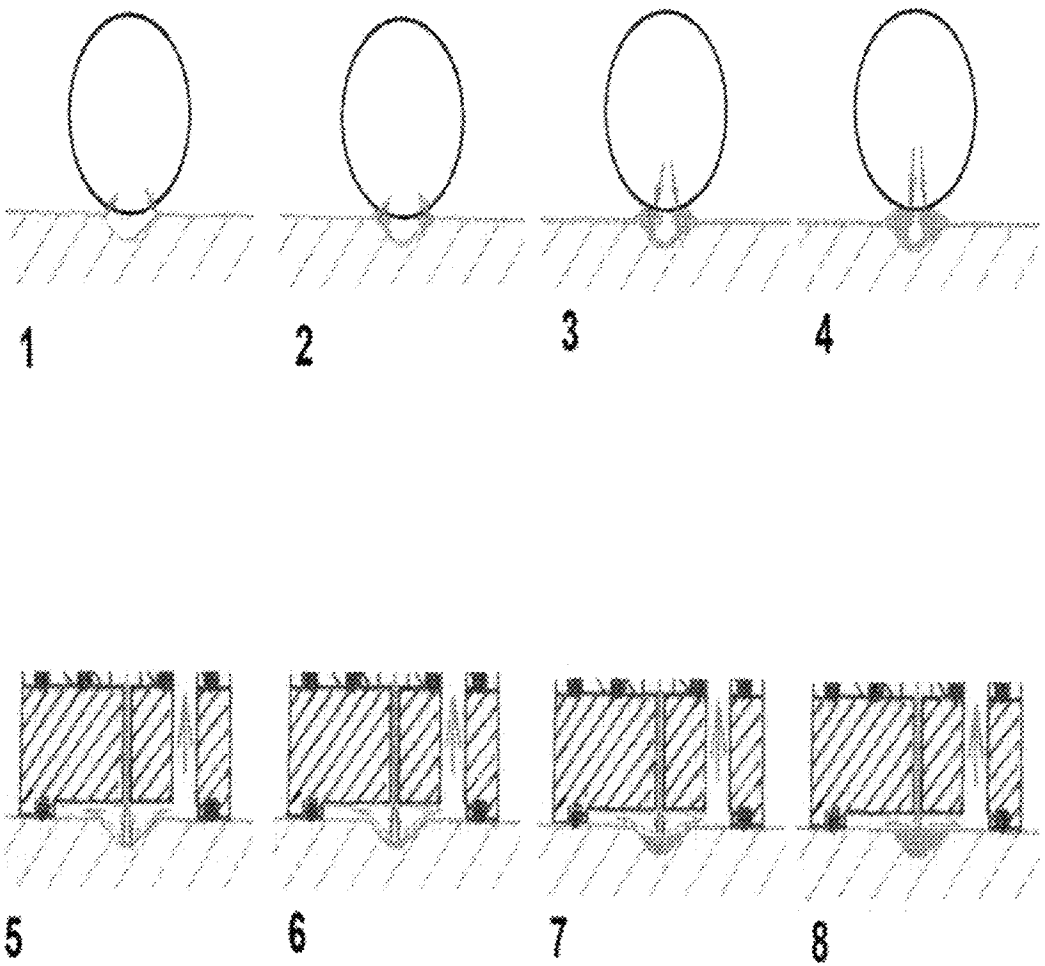
FIG. 17—Sketch of how traditional brush anode and pit filling anodes repair a pit.
Figure 18:
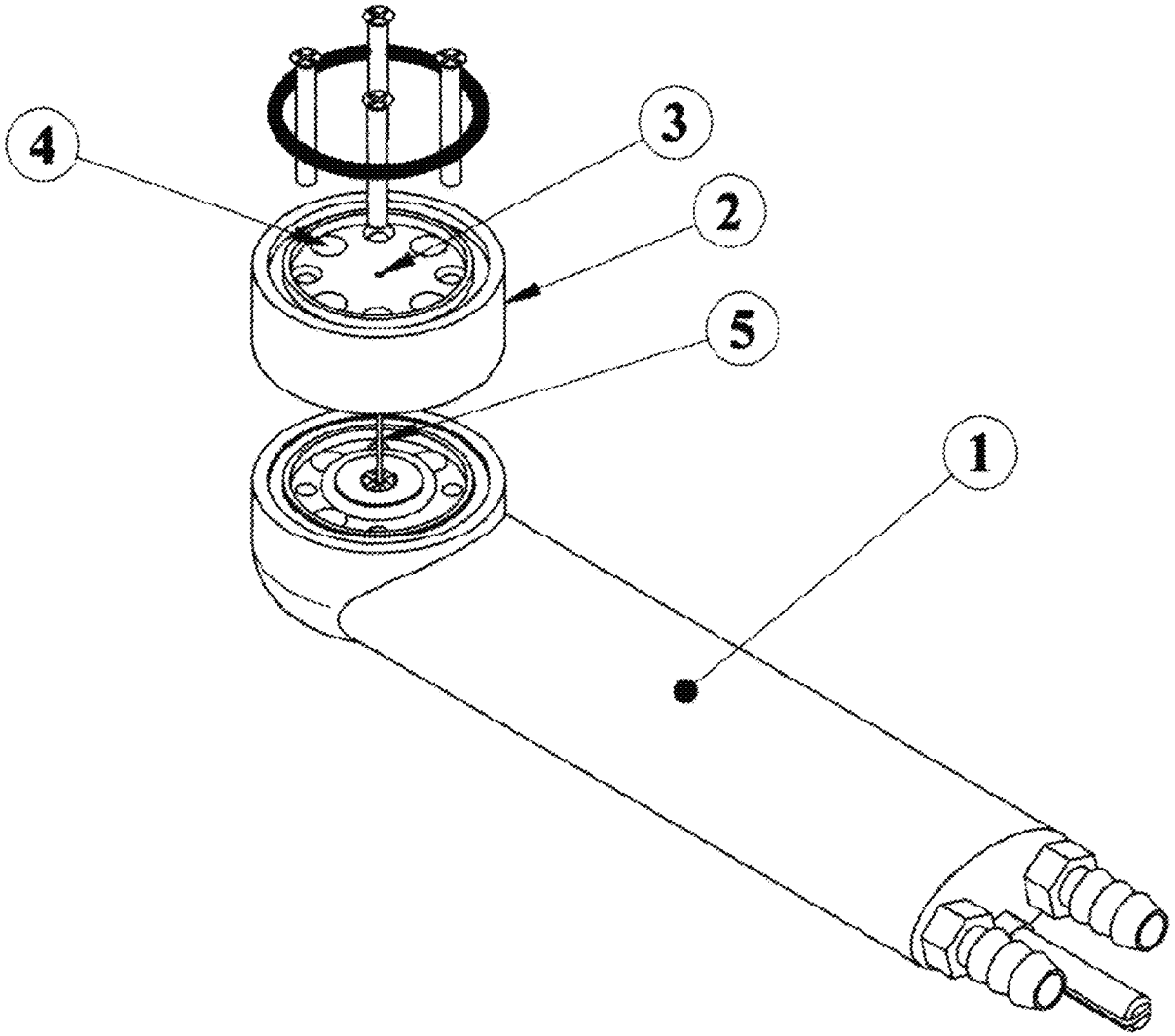
FIG. 18—Pit filling anode's perspective drawing of exposed parts.
Figure 19:
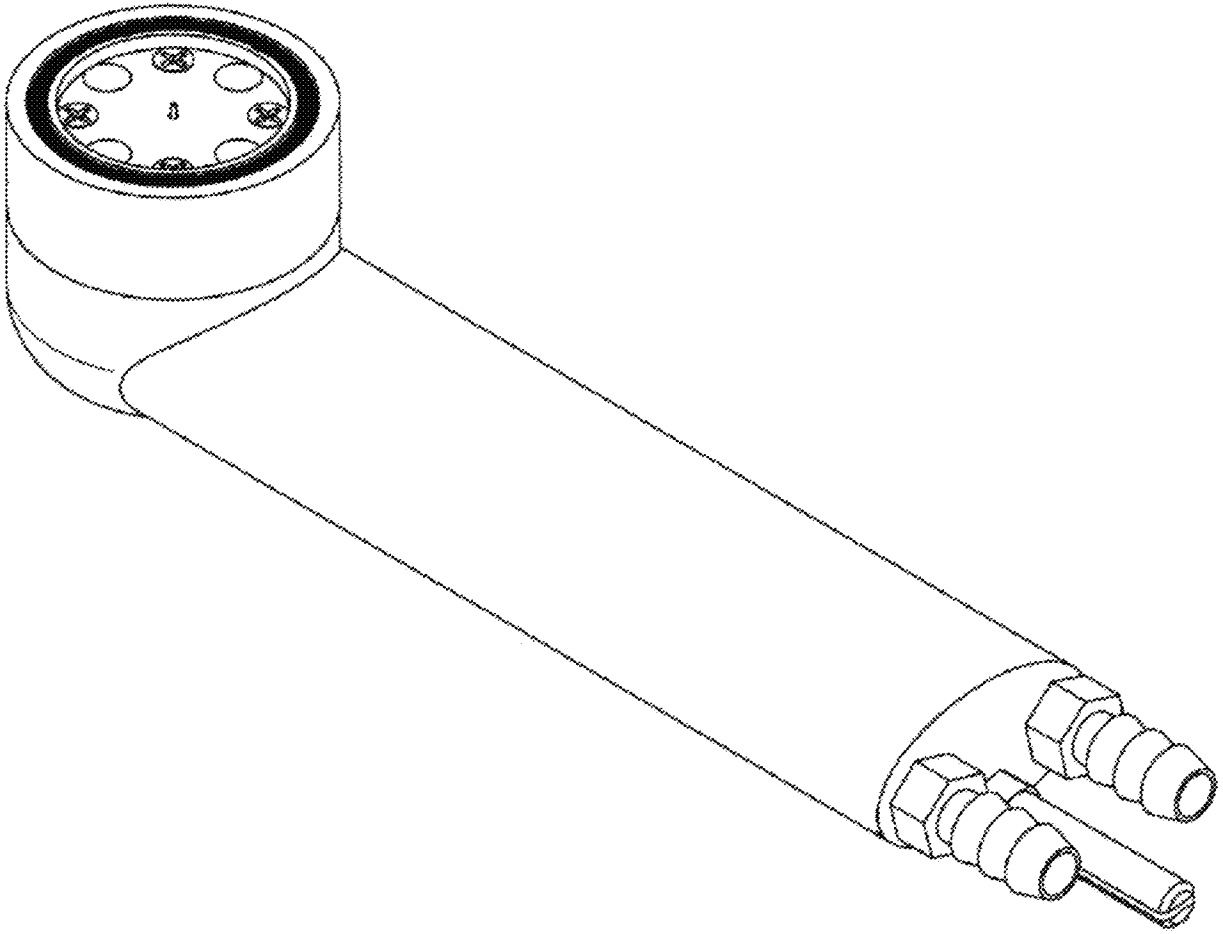
FIG. 19—Pit filling anode's perspective assembly drawing.
Figure 20:
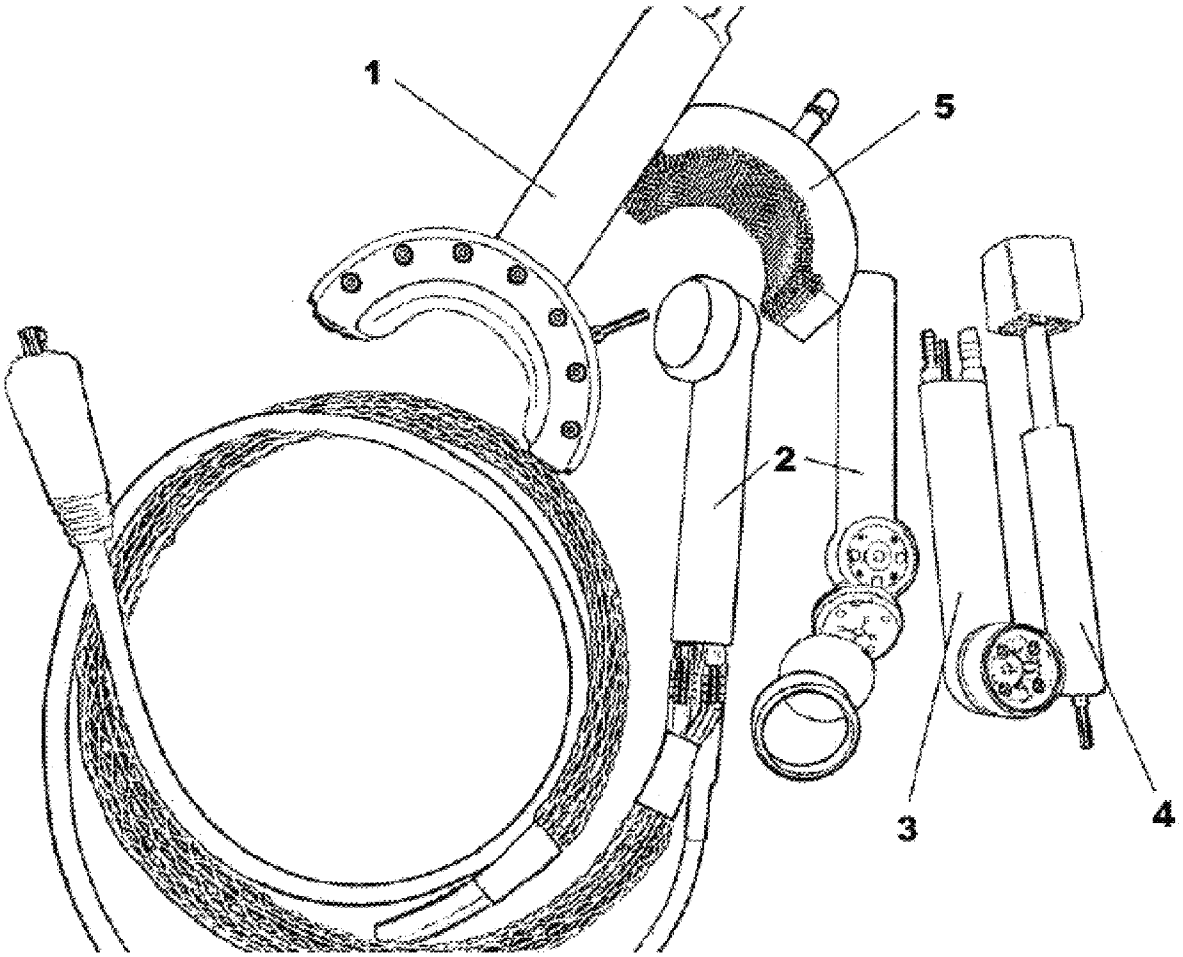
FIG. 20—Traditional and Leak Free anodes actual pictures.
Figure 21:
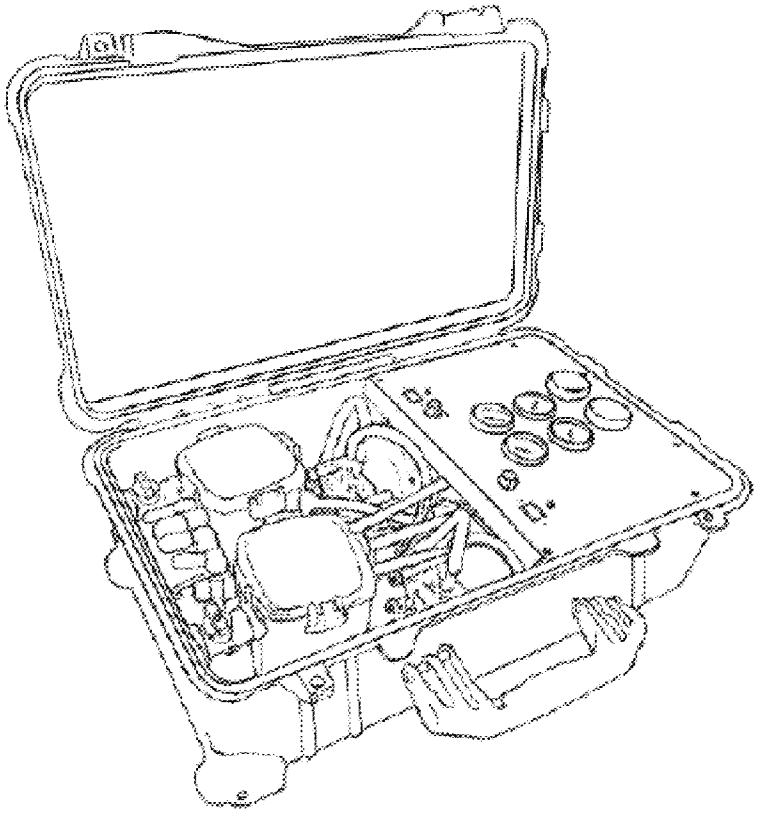
FIG. 21—Double electrolyte unit's finished product picture.
Figure 22:
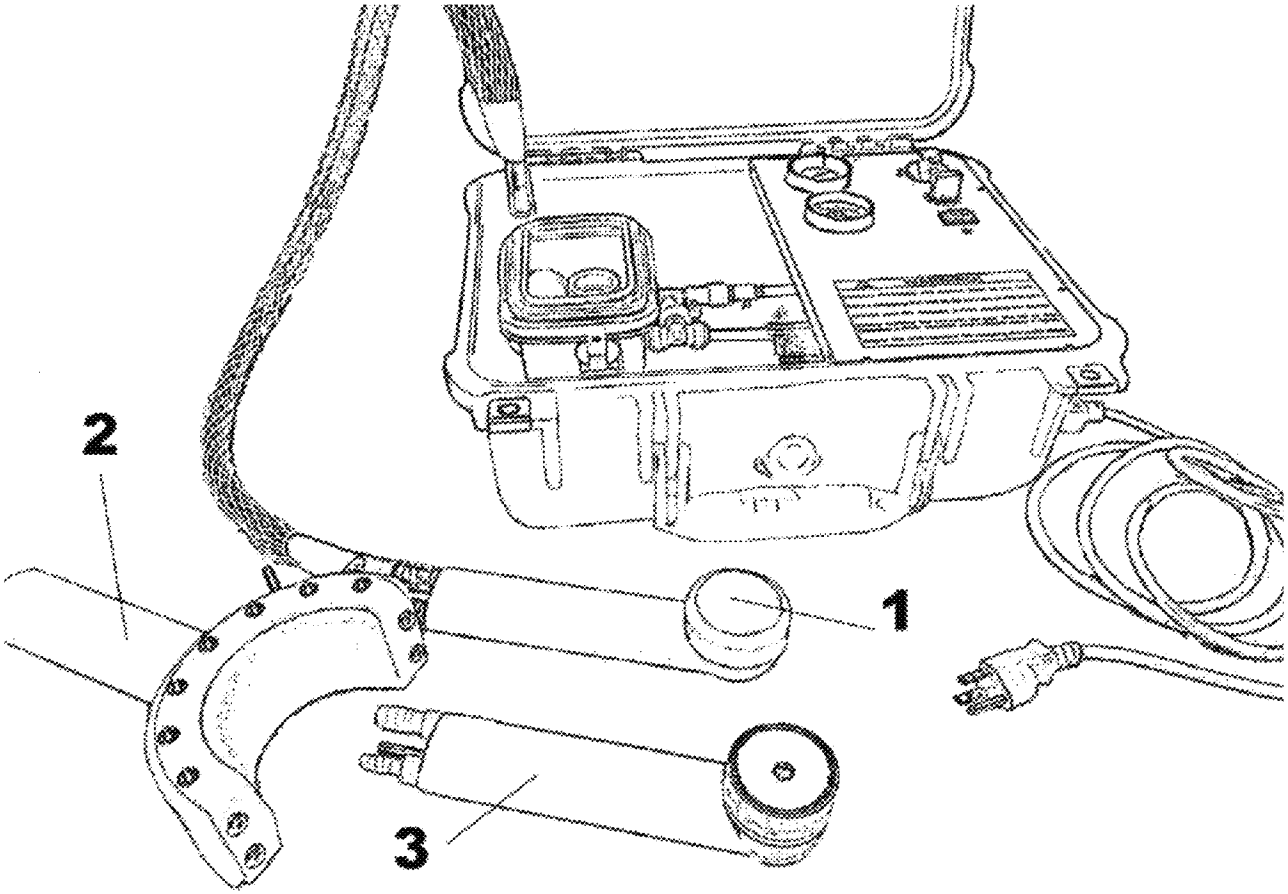
FIG. 22—Single electrolyte unit's finished product and anodes picture.
Figure 23:
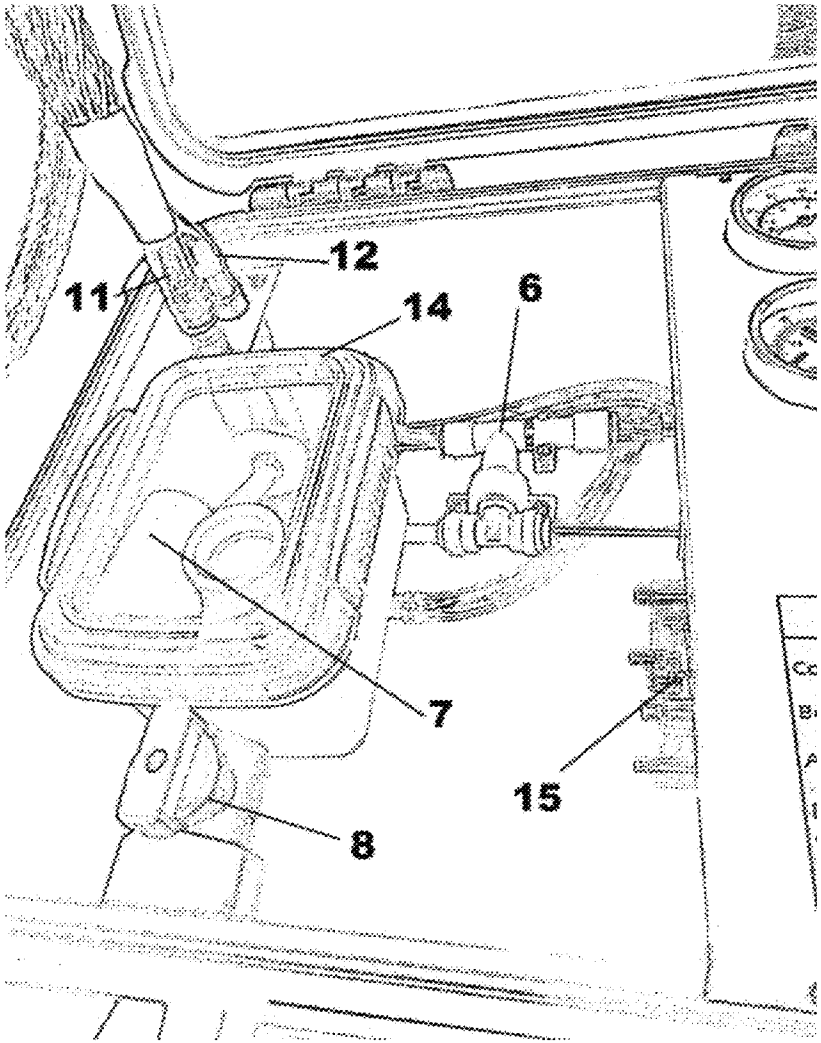
FIG. 23 illustrates the Main Parts of Single electroplating unit having a vacuum pump ejector 6, a baffle 7 formed from two angled plates, an exhaust valve 8, a suction line 11, a delivery line 12, a solution chamber 14 and a peristaltic pump 15.
Figure 24:
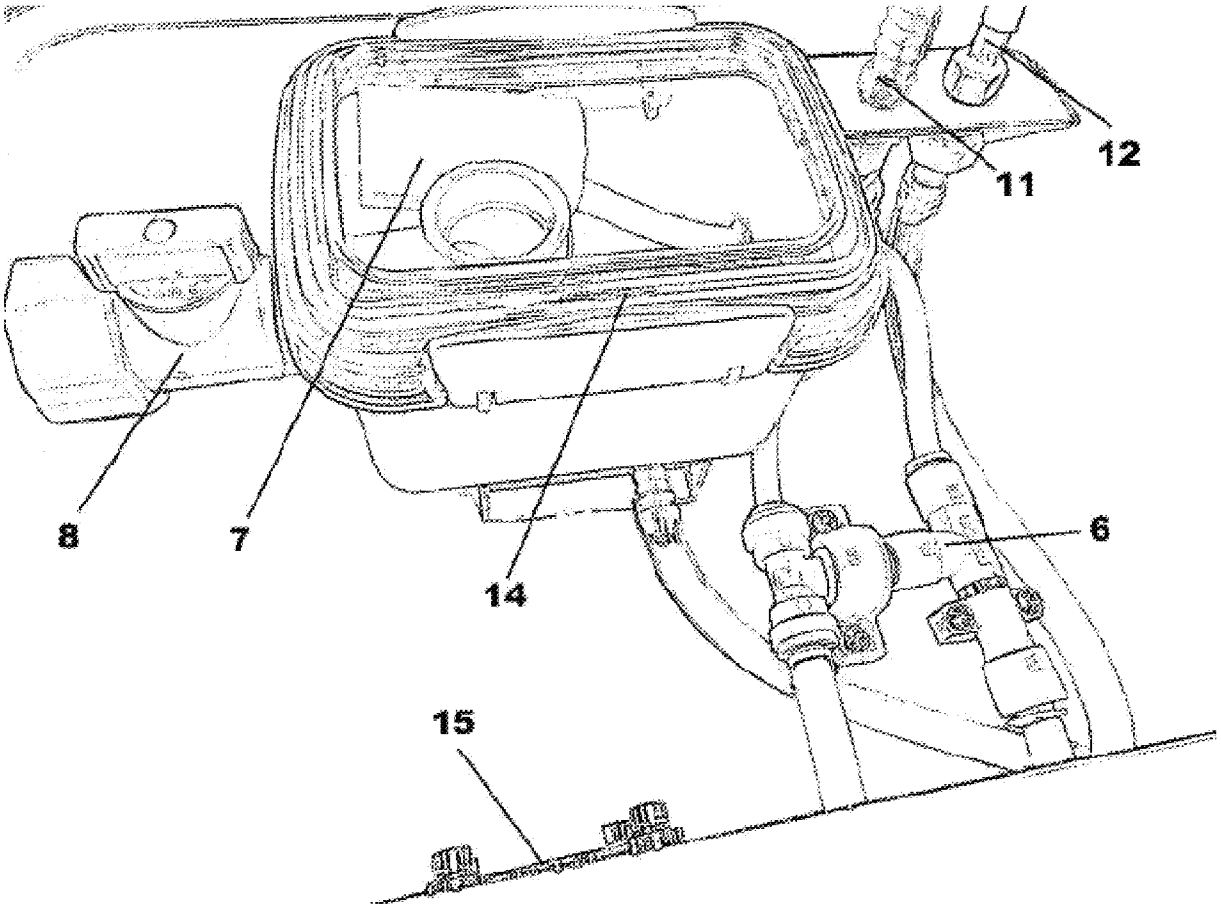
FIG. 24 illustrates the Main Parts of Single electroplating unit.
Figure 25:
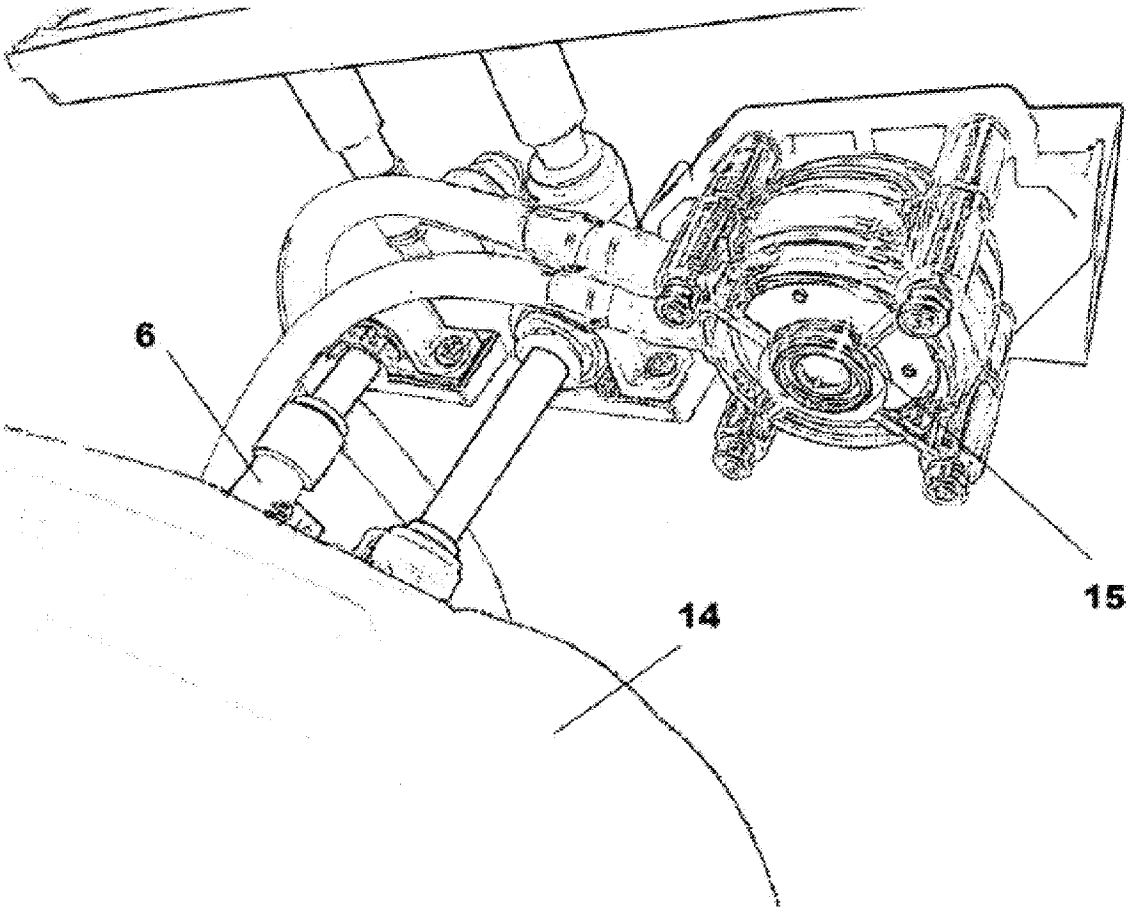
FIG. 25 illustrates some components of an electroplating unit.

Pit filling anode (FIG. 16 thru 19) has a similar handle (FIGS. 16 & 18-1) as flat surface anode but distributor (FIGS. 16 & 18-2) has only one small delivery channel (FIGS. 16 & 18-3) in the middle with platinum clad niobium wire (FIGS. 16 & 18-5) in it and has four suction channels (FIGS. 16 & 18-4). When solution directly jetting (FIG. 16-6) in the pit or void platinum clad niobium wire charges the ions in the solution without touching the cathode. This anode holds the surface with vacuum and the same vacuum returns the excess solution back to the chamber. On FIG. 17 you can see how the Pit Filling Anode works vs traditional anode. Electrical current wants to travel the shortest distance. That's why when we use a regular traditional anode, (FIG. 17-1 thru 4) plating builds on the edge of the pit and at the end it leaves a void in the plating. Operator constantly stops plating and grinds the build ups on the edge to allow more plating to go to bottom of the pit. It is time consuming and a frustrating operation. Pit Filling Anode (FIG. 17-5 thru 8) jets the electrically charged electrolyte at the bottom of the pits and starts to build from the bottom up in one shot.

After we finished electroplating, by switching the pump in reverse direction it then returns the solution to the chamber in both ways. When we are sure the lines are empty, shut down the air and the pump. Disconnect delivery and suction lines from the unit. By connecting a short tygon tube to the delivery connection on the unit, we can then empty the solution to a safer container from the chamber. Before carrying the unit away, disconnect the compressed air, unplug the pump, shut the exhaust valve and plug the delivery and the suction connections on the unit.

The invention claimed is:

1. A brush electroplating system comprising:

an anode handle having batting;

a chamber for containing solution;

a distributor coupled to the anode handle for spreadingthe solution to the batting at a plurality of delivery points;

a delivery system including a peristaltic pump for supplyingthe solution to the distributor;

a suction system with a vacuum pump ejector for creating vacuum to remove excess solution from the anode handle via a plurality of suction points, wherein the excesssolution is mixed with air; and a baffle in fluid communication with the chamber configured to receive the excess solution and air mixture from the suction system and return the solution to the chamber and vent the air as exhaust, wherein the suction system has an adjustment knob for adjustingthe vacuum to balance with the delivery system for maintaining a desired level of wetness of the batting of the anode handle and prevent dripping, wherein the anode handle has: a) an elongated proximal manual grip portion along an axis; and b) a distal end that forms a circular area perpendicular to the manual grip portion, the circular area having: i) a central supply outlet in communication with the delivery system for supplying the solution; ii) a first flange surrounding the central supply outlet; and iii) at least one suction inlet radially outward of the first flange; and iv) a second flange radially outward of the at least one suction inlet so that the at least one suction inlet is in an annular trough between the flanges, and wherein the distributor has: a proximal flat surface that seals against the first and second flanges to enclose the trough so that vacuum from the at least one suction inlet is distributed within the trough; a distal flat surface forming at least one release outlet in fluid communication with the central supply outlet; and a sidewall extending between the proximal flat surface and the distal flat surface, the sidewall forming arcuate suction inlets in fluid communication with the annular trough for distributedly applying the vacuum to the batting.

2. A brush electroplating system as recited in claim 1, wherein the anode handle includes an anode selected from the group consisting: of a flat surface anode; a cylindrical surface anode; and a pit filling anode.

3. A brush electroplating system as recited in claim 1, further comprising: a platinum clad niobium mesh over the batting; and a cover ring for holding the batting.

4. A brush electroplating system as recited in claim 1, wherein the at least one release outlet is "+" shaped.

5. A brush electroplatingsystem as recited in claim 1, wherein the at least one release outlet is five outlets is a dice pattern with four of the outlets being connected to the central supply outletvia angled channels.

6. A brush electroplating system as recited in claim 1, further comprising a coupling ring attached to the anode handle for pressing the batting against the distal flat surface.

7. A brush electroplating system as recited in claim 6, wherein the coupling ring extends beyond the distal flat surface, and further comprising an o-ring fixed into the coupling ring to seal against an item being electroplated.

8. A brush electroplating system comprising:

a chamber for storing an electroplating solution;

an anode handle having batting and a distributorconfigured to spread the solution at multiple points to completely wet the batting, wherein the batting covers a positively charged platinum clad niobium mesh to preventthe mesh from touching a work piece directly;

a delivery system including an adjustable peristaltic pump configured to delivera solution to the anode handle; and a suction system including: a vacuum pump ejector powered by compressed air; and an air valve for adjusting the compressed air to vary the vacuum created by the vacuum pump ejectorand, in turn, balance delivery of the solution from the peristaltic pump so that the batting of the anode handle is wet without dripping, wherein the anode handle has: a) an elongated proximal manual grip portion along an axis; and b) a distal end that forms a circular area perpendicularto the manual grip portion, the circular area having: i) a central supply outlet in communication with the delivery system for supplyingthe solution; ii) a first flange surrounding the central supply outlet; and iii) at least one suction inlet radiallyoutward of the first flange; and iv) a second flange radially outward of the at least one suction inlet so that the at least one suction inlet is in an annular trough between the flanges, and wherein the distributor has: a proximal flat surface that seals against the first and second flangesto enclose the trough so that vacuum from the at least one suction inlet is distributed within the trough; a distal flat surface forming at least one release outlet in fluid communication with the central supply outlet; and a sidewall extending between the proximal flat surface and the distal flat surface, the sidewall forming arcuate suction inlets in fluid communication with the annular trough for distributedlyapplyingthe vacuum to the batting.

9. A brush electroplating system as recited in claim 8, wherein the vacuum pump ejector provides the vacuum to a plurality of suction poi ntssurrounding the multiple points formed by the distributorto suck any excess solution from the batting of the anode handle and send the excess solution mixed with air back to the chamber.

10. A brush electroplating system as recited in claim 9, further comprising at least one angled plate in the chamber as a baffle so that when an air solution mixture hits the at least one angled plate in the chamber, the solution then flows down in the chamber and air leaves from an air discharge valve in fluid communication with a point in the chamber above the at least one angled plate.

11. A brush electroplating system as recited in claim 8, wherein the anode handle includes an anode that is a flat surface anode.

12. A brush electroplatingsystem as recited in claim 8, wherein the multiple points form a "+" shaped nozzle in fluid communication with the batting and wherein the vacuum pump ejector providesthe vacuum to a plurality of suction points surrounding the "+" shaped nozzle to suck the solution from the batting of the anode handle.

13. A brush electroplating system as recited in claim 8, wherein the peristaltic pump is reversible so that upon completion of electroplating, the peristaltic pump is configured to be reversed to clean the anode handle of the electroplating solution.

* * * * *